United States Patent [19]

Taylor, Sr.

[11] Patent Number: 4,526,008

[45] Date of Patent: Jul. 2, 1985

[54] PNEUMATICALLY CONTROLLED SPLIT CYCLE COOLER

[75] Inventor: Carol O. Taylor, Sr., Anna, Tex.

[73] Assignee: Texas Instruments Incorporated, Dallas, Tex.

[21] Appl. No.: 477,035

[22] Filed: Mar. 21, 1983

[51] Int. Cl.[3] ..... F25B 9/00

[52] U.S. Cl. ..... 62/6; 60/520

[58] Field of Search ..... 62/6; 60/517, 520

[56] References Cited

U.S. PATENT DOCUMENTS

| | | | |
|---|---|---|---|
| 3,523,427 | 8/1970 | Simpson | 62/6 |
| 3,765,187 | 10/1973 | Horn | 62/6 |
| 3,793,846 | 2/1974 | Dehne | 62/6 |
| 3,991,586 | 11/1976 | Acord | 62/6 |
| 4,206,609 | 6/1980 | Durenec | 62/6 |

*Primary Examiner*—Ronald C. Capossela

*Attorney, Agent, or Firm*—Alva H. Bandy; Leo N. Heiting; Melvin Sharp

[57] ABSTRACT

A pneumatically controlled split cycle cooler utilizes a dual piston compressor in conjunction with a remotely positioned head, the dual pistons are angularly spaced to provide in phase and out of phase pressure pulses for the head; and the head includes a pneumatic piston having an upwardly extending stem to which is attached a displacer/regenerator, a coldfinger, and a pair of pressure volumes spaced above and below the piston by seals and a pneumatic dampening volume between the seals, said pressure volumes operatively connected to the dual pistons for adding and subtracting their pressures in a complementary manner for proper timing and location of the displacer/regenerator and said pneumatic dampening volume operative to provide a pneumatic dampening of the piston to prevent the displacer/regenerator from striking the ends of the cooler and creating audible noise and microphonic inputs to a load to be cooled.

5 Claims, 4 Drawing Figures

PNEUMATICALLY CONTROLLED SPLIT CYCLE COOLER

This invention relates to Stirling cycle coolers and more particularly to a pneumatically controlled split cycle cooler.

In the past cryogenic coolers for infrared detectors including those of a pneumatic Stirling cycle type such as that described in U.S. Pat. No. 3,765,187 have suffered from short meantime before failure rates, short maintenance intervals and high acoustic noise. The short life time and maintenance intervals of previous split pneumatic cycle systems are attributable to the intolerance of the displacer/regenerators to variations in seal friction. The problem of seal friction in pneumatic type systems increases with the use of the system owing to the wear and tear of the seals as a primary source of the contaminants.

In addition in pneumatic Stirling cycle coolers the free moving displacer/regenerator travels between the cooler ends until abruptly stopped by these ends. This stopping action generates substantial audible noise as well as microphonic inputs to the load (detectors) attached to the cooler.

Further, split cycle pneumatically operated cryogenic coolers heretofore known have lacked a positive means of timing and placing the slidable regenerator in the proper phase with the compression and expansion of the cryogen, normally helium.

Accordingly it is an object of this invention to provide a pneumatically controlled split cycle cooler in which seal friction is substantially reduced by use of clearance seals.

Another object of this invention is to provide a pneumatically controlled split cycle cooler having substantially reduced audible noise.

A further object of the invention is to provide a pneumatically controlled split cycle cooler having increased operating reliability and efficiency.

Briefly stated the pneumatically controlled split cycle cooler utilizes a dual piston compressor in conjunction with a remotely positioned cold head. The dual pistons are operated out of phase to provide pressure pulses in pressure volumes located in the head above and below a pneumatic piston having attached thereto a displacer/regenerator for moving the piston for proper timing and location of the attached movable displacer during the cycle. The pneumatic piston movement is limited by stops positioned above and below the piston and a dead volume is provided between the pressure volumes for dampening pneumatically the pneumatic piston.

These and other objects and features of the invention will become more readily understood in the following detailed description taken in conjunction with the drawings in which.

Figure 1:
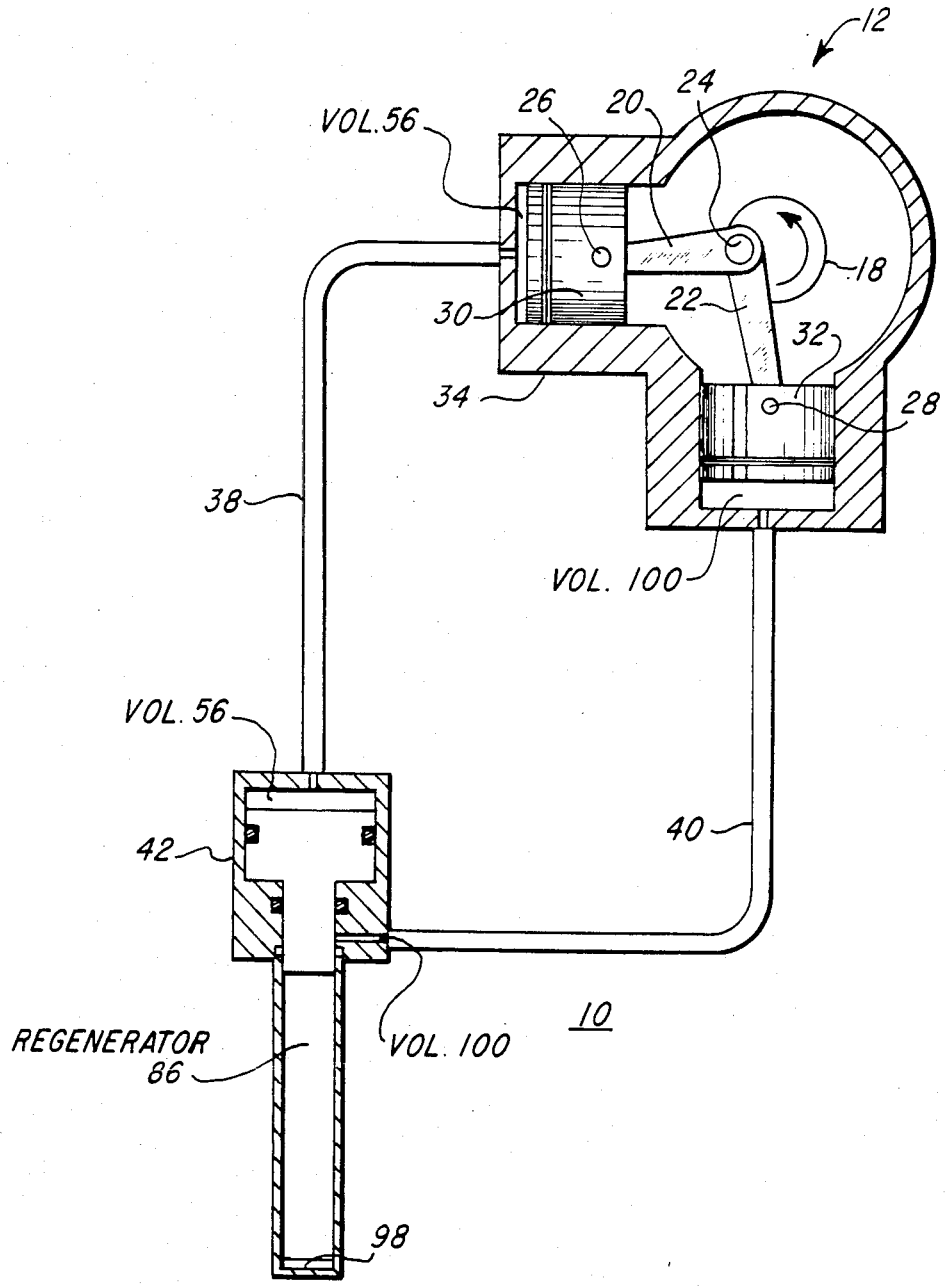
FIG. 1 is a view partly in cross-section of the pneumatic controlled split cycle cooler with dual piston compressor constituting the subject matter of this invention.

Referring now to FIG. 1, the pneumatically controlled split cycle cooler with dual piston compressor 10 comprises a compressor housing 12 having a motor drive shaft 18 driven by a motor (not shown) attached to housing 12. A cam 24 is attached to the motor drive shaft 18. A pair of piston rods 20 and 22 are connected to the cam to provide a selected offset from the motor drive shaft 18 and by connecting pins 26 and 28 to pistons 30 and 32, respectively. Pistons 30 and 32 are mounted in cylinders 34 and 36 of compressor housing 12. A pair of pneumatic lines 38 and 40 are connected, respectively, to an expander housing 42.

Figure 2:
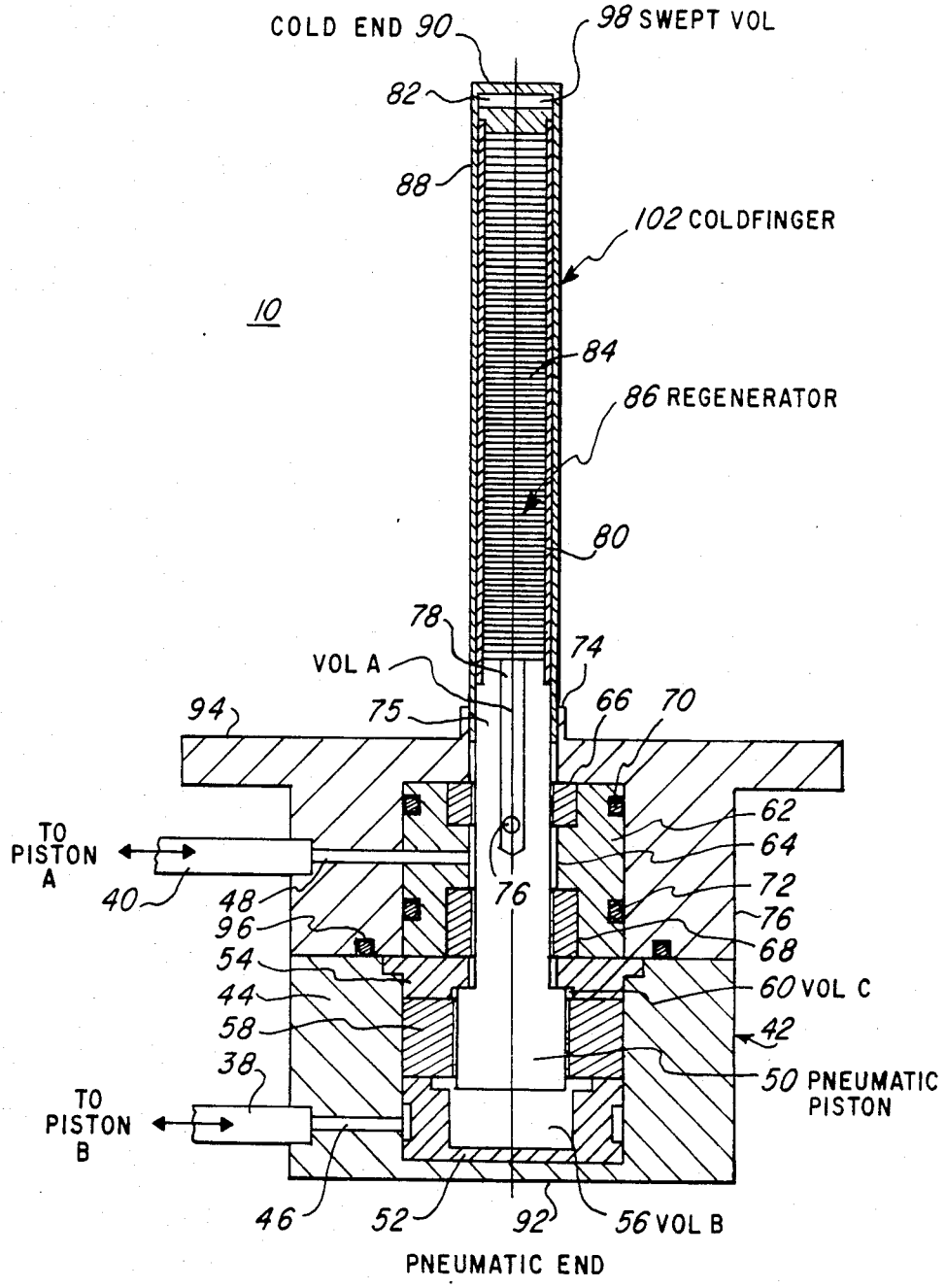
FIG. 2 is an enlarged cross-sectional view of the pneumatic controlled split cycle cooler without the dual piston compressor; and FIGS. *3a* and *3b* are diagrams showing the pressure resulting in the pneumatically controlled split cycle cooler resulting from the action of the dual piston compressor.

The expander housing 32 (FIG. 2) in one embodiment has walls forming a cylinder 44 and conduits 46 and 48 in communication, respectively, with pneumatic lines 38 and 40. A pneumatic piston 50 is mounted within the piston cylinder 44 between non-metallic bumpers 52 and 54. Non-metallic bumpers 52 and 54 are, for example, made of materials sold under the trademarks Nylon or Teflon. Bumper 52 is recessed to form a volume 56 in communication with conduit 46. A clearance seal 58 is positioned between the bumpers 52 and 54 and is in sealing engagement with the piston 50 to close off the volume 56. Seal 58 is a clearance seal formed by minimum clearance between the piston and cylinder wall thus restricting fluid flow. Bumper 54 is annularly shaped and of a diameter to form a pneumatic dampening volume 60. Volume 60 is a dead volume which acts to slow the piston 50 prior to engaging the bumpers 52 or 54. It will be appreciated that this dead volume 60 in a second embodiment can be eliminated without detracting from the cooler operation, but its presence reduces noise and to a lesser extent bumper wear.

A seal supporting block 62 is mounted in cylinder 44 above bumper 54. The seal supporting block is, for example, cylindrically shaped to form an elongated cylindrical passage 64. Passage 64 is sealed by clearance seals 66 and 68 mounted respectively, at top and bottom ends of the seal supporting block 62. A pair of O-rings 70 and 72 are mounted in recess formed in the outer wall of the seal supporting block adjacent to its top and bottom ends.

Pneumatic piston 50 is a solid metal piston of a hardenable material such as, for example, AISI 440C. Piston 50 has a stem 75 extending through bumper 54, seal supporting block 62 and collar 74 of expander housing 42. The stem 75 is preferably formed as an integral part of pneumatic piston 50 and has walls forming an aperture 76 and a passage 78. Aperture 76 is positioned on the stem to open into cylinder 64 throughout the reciprocating action of pneumatic piston 50 and aperture passage 78 extends upwardly along the vertical axis of stem 75 to its top surface.

A free displacer housing 80 has an open end rigidly secured to the top of stem 75 and a perforated end 82 opposing the open end. The free displacer housing 80 is filled with a material 84 of high thermal capacity such as, for example, lead balls or stainless steel screen. The free displacer housing 80 filled with the high thermal capacity matrix constitutes a regenerator 86 (or as often called a displacer/regenerator).

A cylindrical tube 88 has a closed end 90 and an opposing open end. The open end of cylindrical tube 88 is mounted in the collar 74 of the expander housing 42.

It is to be noted that the expander housing 42 is divided into two portions 92 and 94 in order to facilitate assembly. The seal support block 62 with the seals attached is inserted into the upper portion 94. Then the piston stem 75 with the regenerator 86 attached is inserted through bumper 54 and upper portion 94 of expander housing 42 into the tube 88. Next an O-ring 96 is inserted in the lower surface of the upper portion 94. Then the lower portion 92 of the expander housing 42, with the bumper 52 and seal 58 inserted therein, is attached to the upper portion 94 of the expander housing 42.

It will further be noted that with the pneumatic piston reciprocating a volume 98, referred to as the swept volume, is formed between the closed ends 82 and 90, respectively, of the regenerator 86 and tube 88.

In operation the system 10 is filled with a suitable cryogen such as, for example, helium. The compressor motor 16 rotates the cam 18 counterclockwise to drive first the piston 30 and secondly the piston 32 in a reciprocating fashion in their respective cylinders 34 and 36 to create two cryogenic pressure pulses A and B (FIG. 3*a*) in the working fluid in a phased relationship. The phased relationship should not be less than 30° nor more than 150° with 90° to 130° preferred. The pressure wave thus formed by piston 32 (FIG. 1) travels through tube 40 and then through displacer/regenerator 86 (FIG. 2) into the cold swept volume 98 hereinafter collectively referred to as volume 100. While the pressure wave formed by piston 30 (FIG. 1) travels through tube 38 and into the control pneumatic volume 56 (FIG. 2) (volume 56 includes the volume of the tube 38 and piston 30 displacement volume). The volumes 56 and 100 are separated and isolated by seals 66 and 68 and further isolated by the pneumatic dampening volume 60 and seal 58 in the cooler head 42.

The cryogenic cycle, which is a modification of the reverse Stirling engine cryogenic cycle, is as follows:

First the displacer/regenerator 86 is moving to the cold end 90 thereby reducing the cold swept volume 98. The pressure in the pneumatic volume 56 (curve B, FIG. 3*a*) is incresing ($T_0$) with the swept volume pressure at its minimum pressure (curve A, FIG. 3*a*). The resultant force continues to move the regenerator to the cold end while concomitantly, the cycle pressure (curve A FIG. 3*a*) over piston 32 is increasing ($T_1$) 90 degrees out of phase (FIG. 3*a*) such that the pressure peak is reached when the displacer/regenerator 86 (FIG. 1) has substantially reduced the swept volume 98, and the heat of compression occurs in the connection tubing 40 rather than at the cold end 90.

Next as the two pressures are equal ($T_2$) the net force on the pneumatic piston 50 reverses and the displacer/regenerator 86 (FIG. 1) moves toward the pneumatic control end 92 thereby increasing the swept volume 98 into which the compressed cryogen in volume 100 is drawn.

Figure 3B:
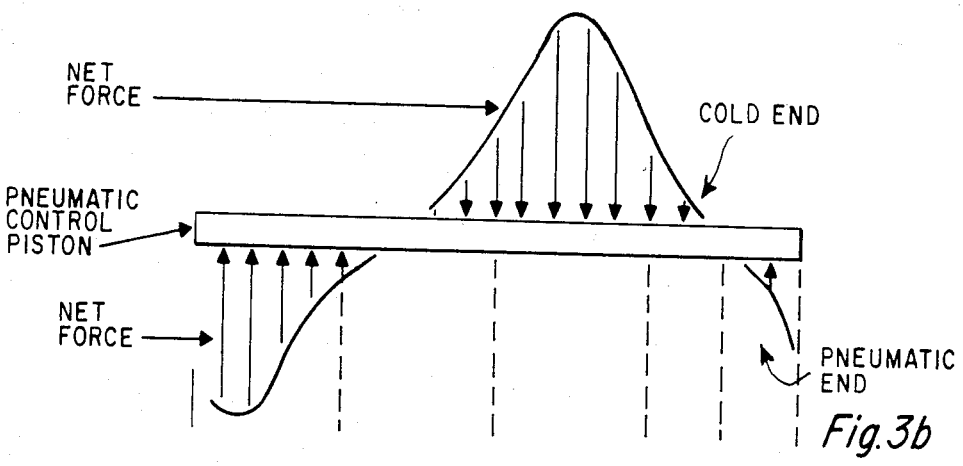

Next as the pressure peak ($T_3$) of piston 32 (FIG. 1) is reached piston 30 is going to the bottom of its stroke thereby increasing the pneumatic volume 56 (FIG. 1). The pressure force (FIG. 3*b*) on the pneumatic piston 50 is increasing (FIG. 3*b*) which continues to move the displacer/regenerator toward the pneumatic control end to provide the maximum swept volume 98.

Figure 3A:
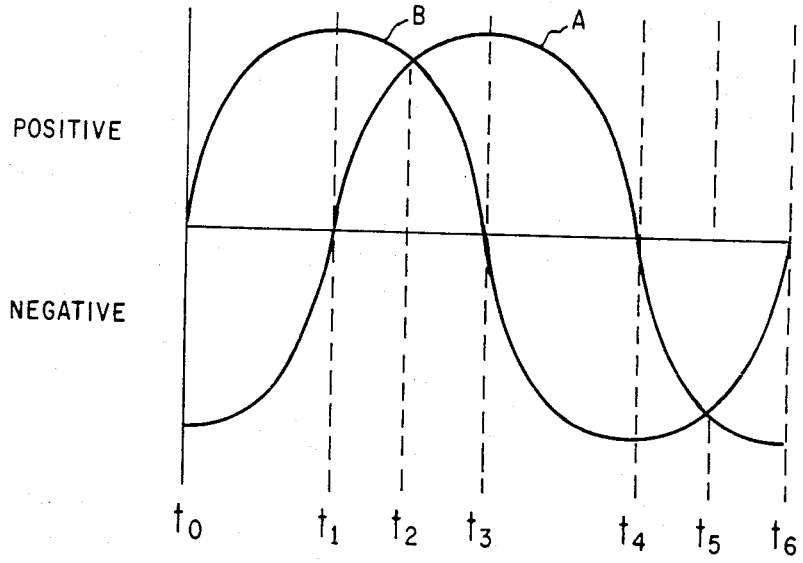

At ($T_4$) the piston 30 reaches the bottom of its stroke and reverses direction. Concomitantly, piston 32 is moving toward the bottom of its stroke (FIG. 3*a*). Then as the volume 100 increases the cryogen therein expands to reduce the pressure and with the reduction of pressure in the swept volume 98 (FIG. 2) work is extracted from the cryogen to cool end 90 of tube 88 to produce refrigeration at the tip of the coldfinger 102 for cooling a load.

Next as the two pressures are equal ($T_5$) the net force on the pneumatic piston 50 reverses and the displacer/regenerator 86 (FIG. 1) moves toward the cold end 90 the cycle then repeats.

Although several embodiments of this invention have been described herein, it will be apparent to a person skilled in the art that various modifications to the details of construction shown and described may be made without departing from the scope of this invention.

What is claimed is:

1. A pneumatically controlled split cycle cooler comprising a compressor means including a plurality of selectively spaced pistons for generating a plurality of selectively spaced pressure waves, said plurality of selectively spaced pistons including two pistons spaced from about 30 degrees to 150 degrees apart to produce in phase and out of phase pressure waves, and a cold head means in operative communication with the compressor means for receiving the plurality of pressure waves for controlling the operation of the cold head means and producing a cold spot at a preselected location within the cold head means, said cold head means including a base member having a wall forming a space and a plurality of spaced pneumatic air passages and a collar in open communication with the space, and a tubular member rigidly mounted in said collar; a seal support member mounted in said housing space, said member having interior and exterior surfaces and a pneumatic passage passing through the seal support member, a first plurality of spaced clearance seals mounted on the interior surface of the seal support member, said seals and interior surface forming an elongated, vertically extending recess and a second plurality of spaced seals on the outer surface above and below the pneumatic passage in sealing engagement with the space forming housing wall; a first bumper means mounted in the housing space adjacent to the seal support member, said bumper member having a stop member and an aperture forming wall; a sealing means mounted in the housing adjacent to the first bumper means, said sealing means having an aperture forming wall; a second bumper means having a wall forming a recess, a pneumatic passage to the recess and a stop member; a pneumatic piston means including a piston and an upwardly extending stem, said piston mounted in the apertures of the first bumper and corresponding seal and the recess of the second bumper means for reciprocation between the stop members of the first and second bumper means and said stem extending upwardly through the apertures of the first bumper means, seal support member and into the tubular member attached to the collar of the housing means and having a wall forming a vertically extending well and a horizontal passage in open communication with the well and vertical recess of the seal support means, and a displacer/regenerator rigidly attached to the stem in communication with the stem well whereby cryogenic pressures selectively admitted above and below the piston provides a reciprocating motion to the piston to properly move the displacer/regenerator for forming a cold end at the end of the housing tube.

2. A pneumatically controlled split cycle cooler according to claim 1, wherein a seal of the first plurality of seals of the seal support member, the aperture forming wall of the first bumper means and the sealing means adjacent the lower end of the first bumper forms a pneumatic dampening volume for the piston.

3. A pneumatically controlled split cycle cooler comprising:

a cylinder means having a closed end for a cold spot and an open end;

a regenerator means mounted in the cylinder means;

an expander housing means having a hollow body portion and first and second ends, said cylinder means fixed to the first end of the expander housing means with its open end in communication with the hollow body portion of the expander housing means, the hollow body portion having walls forming spaced first and second passages therethrough;

a seal supporting block operatively mounted within the hollow body portion adjacent to the first end of the expander housing means, the seal supporting block having spaced end portions and a recess therebetween and walls forming a passage in open communication with the recess and first passage of the expander housing means;

a piston means operatively mounted within the hollow body of the expander housing means, the piston means including a stem and a piston, the stem passing through the seal supporting block and coacting with the spaced end portion of the seal supporting block to form clearance seals for the recess and having opposing ends fixed, respectively, to the regenerator and piston and walls forming a passage in communication with the regenerator and recess and passage of the seal supporting block, the piston being mounted for reciprocation between the seal supporting block and second passage of the expander housing means, the piston coacting with the walls of the body portion to form a clearance seal, the piston and clearance seal defining a volume within said expander housing means in communication with the second passage of the expander housing means;

first and second conduits having ends connected, respectively, to the first and second passages of said housing means; and a dual piston compressor means having first and second piston means operatively connected, respectively, to the first and second conduits for selectively introducing cryogen under pressure to the first and second passages of the expander housing means whereby the piston is reciprocated freely within the expander housing means in response to the pressure variations.

4. A pneumatically controlled split cycle cooler according to claim 3 wherein the expander housing means further comprises first and second spaced bumper means mounted in the hollow body portion of the expander housing means in a spaced relationship to the piston of the piston means for limiting the reciprocating movement of the piston.

5. A pneumatically controlled split cycle cooler according to claim 3 wherein the expander housing means comprises first and second portions and a seal means and wherein the seal supporting block further includes a plurality of seals for sealing the seal supporting block in the first portion of the expander housing means, said first and second means being fixed together with the seal supporting block therebetween for sealing the second portion to the first portion whereby the expander housing means is sealed to prevent loss of cryogen and pressure.

* * * * *